US006334343B1

(12) United States Patent
Nwagbara

(10) Patent No.: US 6,334,343 B1
(45) Date of Patent: Jan. 1, 2002

(54) WASHING MACHINE SCUBBING ENHANCEMENT DEVICE

(76) Inventor: Chibu I. Nwagbara, 1960 Glynmoore Dr., Lawrenceville, GA (US) 30043

( * ) Notice: Subject to any disclaimer, the term of this patent is extended or adjusted under 35 U.S.C. 154(b) by 0 days.

(21) Appl. No.: 09/569,453

(22) Filed: May 12, 2000

(51) Int. Cl.[7] ..... D06F 17/100
(52) U.S. Cl. ..... 68/134; 15/141.1
(58) Field of Search ..... 68/134; 15/183, 15/141.1, 89, 90

(56) References Cited

U.S. PATENT DOCUMENTS

| | | | | |
|---|---|---|---|---|
| 121,883 A | * | 12/1871 | Miller | |
| 1,617,030 A | * | 2/1927 | Rocke | 68/134 |
| 1,745,177 A | * | 1/1930 | Markley | 68/134 |
| 2,056,077 A | * | 9/1936 | Schmeller, Sr. | 68/134 |
| 2,518,107 A | | 8/1950 | Wilson | |
| 3,841,909 A | * | 10/1974 | Noaka et al. | |
| 4,126,910 A | * | 11/1978 | Beer | |
| 4,151,320 A | | 4/1979 | Naka | |
| 4,338,802 A | | 7/1982 | Ohmann et al. | |
| 5,546,629 A | * | 8/1996 | Shim | |
| D379,298 S | | 5/1997 | Bowen et al. | |
| 5,651,278 A | * | 7/1997 | Pinkowski et al. | |
| 5,692,581 A | | 12/1997 | Nelson et al. | |
| 5,862,684 A | * | 1/1999 | Park | |

FOREIGN PATENT DOCUMENTS

| | | | | |
|---|---|---|---|---|
| DE | 1019272 | * | 11/1957 | 68/134 |
| JP | 63-262195 | * | 10/1988 | 68/134 |
| JP | 4-67143 | * | 3/1992 | |

* cited by examiner

*Primary Examiner*—Frankie L. Stinson

(57) ABSTRACT

A washing machine scrubbing enhancement device for improving the cleaning efficiency of washing machines. The washing machine scrubbing enhancement device includes a scrubber attachment comprising a channel member with side walls connected by a base wall forming a channel for gripping the sides of the agitator fins, and an adhesive applied to the side walls.

6 Claims, 2 Drawing Sheets

WASHING MACHINE SCUBBING ENHANCEMENT DEVICE

BACKGROUND OF THE INVENTION

1. Field of the Invention

The present invention relates to washing machine agitators and more particularly pertains to a new washing machine scrubbing enhancement device for improving the cleaning efficiency of washing machines.

2. Description of the Prior Art

The use of washing machine agitators is known in the prior art. More specifically, washing machine agitators heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,518,107; U.S. Pat. No. 5,692,581; U.S. Pat. No. Des. 379,298; U.S. Pat. No. 4,338,802; U.S. Pat. No. 5,651,278; and U.S. Pat. No. 4,151,320.

While these devices fulfill their respective, particular objectives and requirements, the aforementioned patents do not disclose a new washing machine scrubbing enhancement device. The inventive device includes a scrubber attachment comprising a channel member with side walls connected by a base wall forming a channel for gripping the sides of the agitator fins, and an adhesive applied to the side walls.

In these respects, the washing machine scrubbing enhancement device according to the present invention substantially departs from the conventional concepts and designs of the prior art, and in so doing provides an apparatus primarily developed for the purpose of improving the cleaning efficiency of washing machines.

SUMMARY OF THE INVENTION

In view of the foregoing disadvantages inherent in the known types of washing machine agitators now present in the prior art, the present invention provides a new washing machine scrubbing enhancement device construction wherein the same can be utilized for improving the cleaning efficiency of washing machines.

The general purpose of the present invention, which will be described subsequently in greater detail, is to provide a new washing machine scrubbing enhancement device apparatus and method which has many of the advantages of the washing machine agitators mentioned heretofore and many novel features that result in a new washing machine scrubbing enhancement device which is not anticipated, rendered obvious, suggested, or even implied by any of the prior art washing machine agitators, either alone or in any combination thereof.

To attain this, the present invention generally comprises a scrubber attachment comprising a channel member with side walls connected by a base wall forming a channel for gripping the sides of the agitator fins, and an adhesive applied to the side walls.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new washing machine scrubbing enhancement device apparatus and method which has many of the advantages of the washing machine agitators mentioned heretofore and many novel features that result in a new washing machine scrubbing enhancement device which is not anticipated, rendered obvious, suggested, or even implied by any of the prior art washing machine agitators, either alone or in any combination thereof.

It is another object of the present invention to provide a new washing machine scrubbing enhancement device which may be easily and efficiently manufactured and marketed.

It is a further object of the present invention to provide a new washing machine scrubbing enhancement device which is of a durable and reliable construction.

An even further object of the present invention is to provide a new washing machine scrubbing enhancement device which is susceptible of a low cost of manufacture with regard to both materials and labor, and which accordingly is then susceptible of low prices of sale to the consuming public, thereby making such washing machine scrubbing enhancement device economically available to the buying public.

Still yet another object of the present invention is to provide a new washing machine scrubbing enhancement device which provides in the apparatuses and methods of the prior art some of the advantages thereof, while simultaneously overcoming some of the disadvantages normally associated therewith.

Still another object of the present invention is to provide a new washing machine scrubbing enhancement device for improving the cleaning efficiency of washing machine agitators.

Yet another object of the present invention is to provide a new washing machine scrubbing enhancement device which includes a scrubber attachment comprising a channel member with side walls connected by a base wall forming a channel for gripping the sides of the agitator fins, and an adhesive applied to the side walls.

Still yet another object of the present invention is to provide a new washing machine scrubbing enhancement device that minimizes the quantity of detergent required to clean a specified size and type of load.

Even still another object of the present invention is to provide a new washing machine scrubbing enhancement device that may reduce the total duration of a wash cycle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 4:
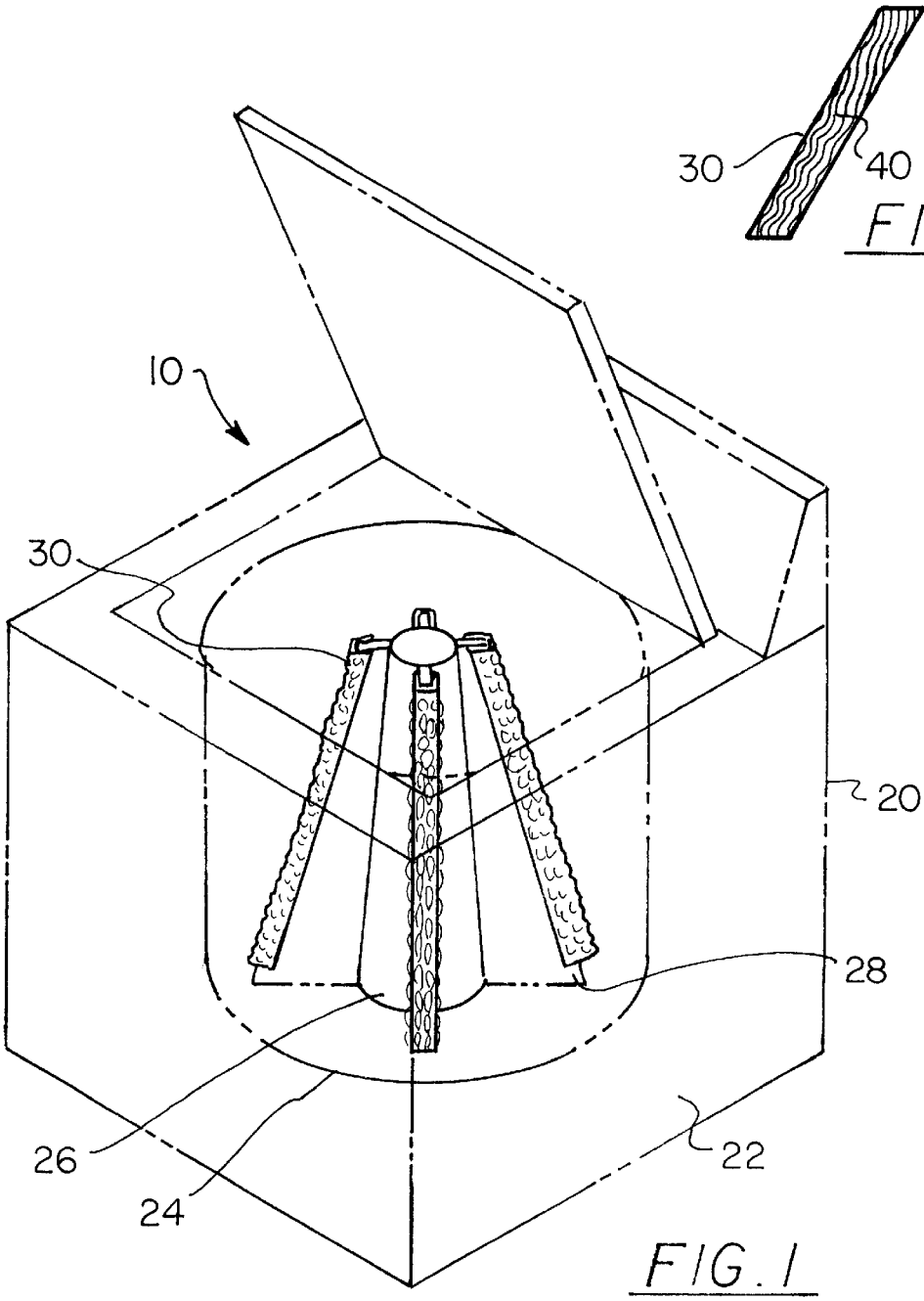
FIG. 1 is a schematic perspective view of a new washing machine scrubbing enhancement device according to the present invention installed on the agitator of a washing machine.
FIG. 4 is a schematic side view of an optional embodiment of the present invention illustrating a plurality of grooves and ridges.
Figure 2:
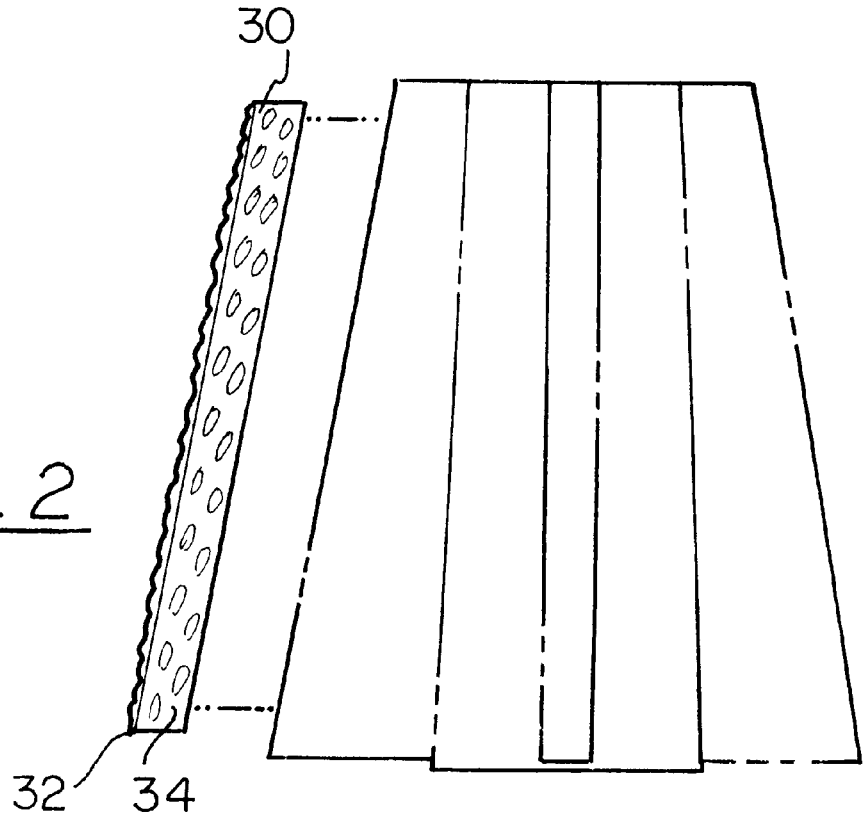
FIG. 2 is a schematic side view of the present invention shown exploded away from an agitator.
Figure 3:
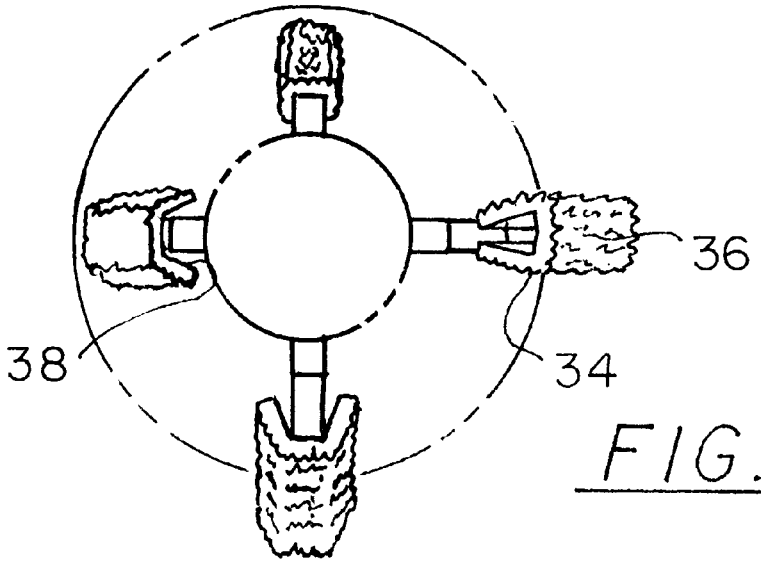
FIG. 3 is a schematic top view of the present invention.

With reference now to the drawings, and in particular to FIGS. 1 through 4 thereof, a new washing machine scrubbing enhancement device embodying the principles and concepts of the present invention and generally designated by the reference numeral 10 will be described.

As best illustrated in FIGS. 1 through 4, the washing machine scrubbing enhancement device 10 generally comprises a clothes washing machine 20 and a scrubber attachment 30.

The clothes washing machine 20 suitable for use with the scrubber attachment may comprise a housing 22, a tub 24, and an agitator 26.

The housing 22 has an upper opening with a lid pivotally mounted to selectively close the upper opening.

The tub 24 is mounted in the housing 22 for rotation. The tub 24 has an opening located adjacent to the upper opening of the housing 22 for permitting items to be inserted and removed from the tub 24 through the upper opening of the housing 22.

The agitator 26 has a central portion with an upper end and a lower end. The agitator 26 also has at least two fins 28 extending generally radially outward from the central portion between the upper and lower ends. Each fin 28 has an outer edge. In an embodiment, the outer edge of each fin 28 has a substantially triangular perimeter shape. However, other fin profiled, either relatively straight or even undulating, may be used with the invention.

The scrubber attachment 30 is mountable on one of the fins 28 of the agitator 26. The scrubber attachment 30 comprises a channel member 32 and an adhesive member 38.

The channel member 32 includes a pair of side walls 34 connected together by a base wall 36 to form a channel shape with an inner groove. The inner groove receives the outer edge of one of the fins 28 of the agitator 26. The side walls 34 are biased towards each other such that the side walls 34 grip a portion of the fin 28 inserted into the interior groove of the channel member 32. The channel member 32 has an inner surface lining the interior groove and an outer surface opposite the interior groove.

The adhesive member 38 may be applied to the side walls 34 for adhering the channel member 32 to the fin 28 of the agitator 26. Suitably, the adhesive is water and detergent resistant.

In one embodiment of the invention, the outer surface has a plurality of raised bumps that contrast with the otherwise smooth surface of the agitator.

In a further embodiment, the outer surface has a plurality of raised ridges 40 with grooves in between. The ridges may be generally serpentine such that the grooves are curvy.

In use, each fin of the agitator has a scrubber attachment mounted to it. The scrubber attachments are secured by the adhesive member of the scrubber attachment and by the gripping action from the bias of the side walls. The machine is then used in the ordinary manner associated with clothes washing machines.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An agitator enhancement apparatus for a washing machine including an agitator having a central portion with an upper end and a lower end, and at least two fins extending generally radially outward from the central portion between the upper and lower ends, the agitator enhancement apparatus comprising:

a scrubber attachment for mounting on each of the fins of the agitator, the scrubber attachment comprising a channel member including a pair of side walls connected together by a base wall to form a channel shape with an interior groove for receiving the outer edge of one of the fins of the agitator, the side walls being biased towards each other such that the side walls grip a portion of the fin inserted into the interior groove of the agitator, the channel member having an inner surface lining the interior groove and an outer surface opposite the interior groove.

2. The apparatus of claim 1 additionally comprising an adhesive being applied to the side walls for adhering the channel member to the fin.

3. The apparatus of claim 1 wherein the outer surface has a plurality of raised bumps formed thereon.

4. The apparatus of claim 1 wherein the outer surface has a plurality of raised ridges formed thereon with grooves therebetween.

5. The apparatus of claim 4 wherein the ridges are generally serpentine such that the grooves are curvy.

6. An enhanced washing machine, comprising:

a clothes washing machine comprising:

a housing having an upper opening with a lid pivotally mounted to selectively close the upper opening;

a tub mounted in the housing for rotation, the tub having an opening located adjacent to the upper opening of the housing for permitting items to be inserted and removed from the tub through the upper opening of the housing;

an agitator having a central portion with an upper end and a lower end, and at least two fins extending generally radially outward from the central portion between the upper and lower ends, each of the fins having an outer edge, wherein the outer edge of each of the fins has a substantially triangular perimeter shape; and a scrubber attachment for mounting on each of the fins of the agitator, the scrubber attachment comprising:

a channel member including a pair of side walls connected together by a base wall to form a channel shape with an interior groove for receiving the outer edge of one of the fins of the agitator, the side walls being biased towards each other such that the side walls grip a portion of the fin inserted into the interior groove of the agitator, the channel member having an inner surface lining the interior groove and an outer surface opposite the interior groove;

an adhesive being applied to the side walls for adhering the channel member to the fin;

wherein the outer surface has a plurality of raised bumps formed thereon.

* * * * *